US006367280B1

(12) United States Patent
Funabasama et al.

(10) Patent No.: US 6,367,280 B1
(45) Date of Patent: Apr. 9, 2002

(54) MOUNTING AND PLACING STRUCTURE FOR REFRIGERATOR

(75) Inventors: Hideo Funabasama; Daikichiro Motegi; Yoshiaki Fujisawa, all of Gunma (JP)

(73) Assignee: Sawafuji Electric Co., LTD, Tokyo (JP)

( * ) Notice: Subject to any disclaimer, the term of this patent is extended or adjusted under 35 U.S.C. 154(b) by 0 days.

(21) Appl. No.: 09/704,695

(22) Filed: Nov. 3, 2000

(30) Foreign Application Priority Data

Nov. 8, 1999 (JP) ..... 11-316944

(51) Int. Cl.[7] ..... F25D 19/00
(52) U.S. Cl. ..... 62/454; 62/440
(58) Field of Search ..... 62/440, 443, 444, 62/451, 454, 263

(56) References Cited

U.S. PATENT DOCUMENTS

| | | | | |
|---|---|---|---|---|
| 2,216,873 A | * | 10/1940 | Browne | 62/263 |
| 2,579,379 A | * | 12/1951 | Fritsche | 62/263 |
| 2,645,100 A | * | 7/1953 | Bascom | 62/263 |
| 4,024,729 A | * | 5/1977 | Abate, Sr. et al. | 62/263 |
| 4,507,937 A | | 4/1985 | Bretz | 62/298 |
| 5,946,929 A | | 9/1999 | Selina et al. | 62/263 |

FOREIGN PATENT DOCUMENTS

| | | | | |
|---|---|---|---|---|
| DE | 30 03 567 | | 7/1980 | |
| EP | 1211274 | | 3/1968 | |
| EP | 0 190 794 | | 1/1986 | |
| JP | 4-214170 A | * | 8/1992 | 62/263 |

* cited by examiner

*Primary Examiner*—William Doerrler
*Assistant Examiner*—Melvin Jones
(74) *Attorney, Agent, or Firm*—Arent Fox Kintner Plotkin & Kahn, PLLC

(57) ABSTRACT

In a structure in which a refrigerator including a compressor and a condenser each constituting a portion of a refrigerating unit and mounted to an outer surface of a rear wall of a refrigerator body is mounted to a stationary support wall in such a manner that the refrigerator body is accommodated in an accommodating recess provided in the support wall, an intake passage into which air can be drawn through a front end thereof, an exhaust passage from which the air can be discharged through a front end thereof, and a communication passage connecting rear ends of the intake passage and the exhaust passage to each other and having the compressor and the condenser accommodated therein, are defined between an inner surface of the accommodating recess and the refrigerator body. A fan for drawing air from the intake passage and discharging the air into the exhaust passage is mounted to the rear wall of the refrigerator body and accommodated in the communication passage. Thus, the aesthetic appearance of the refrigerator can be enhanced, and the compressor and the condenser can be cooled sufficiently.

9 Claims, 8 Drawing Sheets

MOUNTING AND PLACING STRUCTURE FOR REFRIGERATOR

BACKGROUND OF THE INVENTION

1. Field of the Invention

The present invention relates to a mounting and placing structure for a refrigerator which includes a compressor and a condenser each constituting a portion of a refrigerating unit and mounted to an outer surface of a rear wall of a refrigerator body, the refrigerator being mounted to a stationary support wall with the refrigerator body accommodated in an accommodating recess provided in the support wall. Particularly, the invention relates to a mounting and placing structure for a refrigerator which is suitable to be carried in a large-sized vehicle such as a truck or in a ship such as a cruiser.

2. Description of the Related Art

In a conventional placing structure in which a refrigerator is mounted to a support wall in such a manner that a refrigerator body is accommodated in an accommodating recess, an intake bore for drawing air and an exhaust bore for discharging the air are provided in the support wall separately from the accommodating recess for the purpose of escaping heat released from a compressor and a condenser mounted to a rear wall of the refrigerator body.

In the structure in which the intake bore and the exhaust bore are provided in the support wall as in the above conventional structure, however, it is difficult to say that the external appearance of the structure is excellent and moreover, it may be difficult in some cases to ensure a space for provision of the intake bore and the exhaust bore, depending on a placing area.

SUMMARY OF THE INVENTION

Accordingly, it is an object of the present invention to provide a mounting and placing structure for a refrigerator, wherein it is unnecessary to provide the intake bore and the exhaust bore in the support wall, leading to an improved appearance and moreover, the compressor and the condenser can be cooled sufficiently.

To achieve the above object, according to a first aspect and feature of the present invention, there is provided a mounting and placing structure for a refrigerator including a refrigerator body having an opening in a front surface thereof and defining a refrigerating chamber, a door mounted on the front surface of the refrigerator body for opening and closing the opening, and a refrigerating unit for refrigerating said refrigerating chamber, the refrigerator including a compressor and a condenser each constituting a portion of the refrigerating unit and mounted to an outer surface of a rear wall of the refrigerator body, the refrigerator being mounted to a stationary support wall, such that the refrigerator body is accommodated in an accommodating recess provided in the support wall, and the door can be opened and closed outside the accommodating recess, wherein the mounting and placing structure includes an intake passage into which air can be drawn through a front end thereof, an exhaust passage from which the air can be discharged through a front end thereof, and a communication passage which connects rear ends of the intake passage and the exhaust passage to each other, the compressor and said condenser being accommodated in the communication passage, and wherein the intake passage, the exhaust passage and the communication passage are defined between an inner surface of the accommodating recess and the refrigerator body accommodated in the accommodating recess, and a fan is mounted to the rear wall of the refrigerator body and accommodated in the communication passage for drawing air from the intake passage and discharging the air into the exhaust passage.

With such arrangement of the first feature, the air drawn into the intake passage from the outside by the operation of the fan is permitted to flow through the communication passage and then discharged through the exhaust passage to the outside, so that the compressor and condenser accommodated in the communication passage are cooled effectively by the air flowing through the communication passage. Moreover, since the intake passage, the communication passage and the exhaust passage are defined between the inner surface of the accommodating recess and the refrigerator body, it is unnecessary to provide an intake bore and an exhaust bore in the support wall in addition to the accommodating recess. Therefore, the aesthetic appearance can be enhanced by no need for the provision of such intake and exhaust bores, and the compressor and the condenser can be cooled sufficiently.

According to a second aspect and feature of the present invention, in addition to the first feature, the accommodating recess is defined by first and second side surfaces extending vertically in parallel to each other, a ceiling surface connecting upper ends of the first and second side surfaces at right angles to each other, a bottom surface connecting lower ends of the first and second side surfaces at right angles to each other, and a closed end surface connecting rear ends of the side surfaces, the ceiling surface and the bottom surface at right angles to each other; wherein the rear wall of the refrigerator body has a regular quadrilateral vertical-sectional shape and defines the intake passage between the refrigerator body and the bottom surface, and the exhaust passage between the refrigerator body and the ceiling surface, the rear wall including a first wall portion which is adjacent to the first side surface and closer and opposed to the closed end surface in parallel to the closed end surface, and a second wall portion which is adjacent to the second side surface and inclined such that it is spaced farther from the closed end surface as going away from the first wall portion, the first and second wall portions being connected to each other; and wherein the communication passage is of a triangular cross-sectional shape and extends vertically to connect the rear ends of the intake passage and the exhaust passage, the communication passage being defined between the second side surface as well as the closed end surface of the accommodating recess and the second wall portion.

With such arrangement of the second feature, the intake passage, the exhaust passage and the communication passage are defined by only accommodating the refrigerator body in the accommodating recess having the simple right-angled quadrilateral cross-sectional shape. In addition, the cross-sectional area of the communication passage can be set at an allowed small value to the utmost, and the flow speed of the air flowing through the communication passage can be increased to the utmost to enhance the efficiency of cooling the compressor and the condenser. Moreover, the second wall portion constituting a portion of the rear wall of the refrigerator body is defined in such a manner that a corner at the rear end of the refrigerator body is cut out. Thus, goods can be accommodated effectively in the entire refrigerating chamber deeply from its inlet end to its deep end, as compared with a refrigerator in which a central portion of a rear wall is recessed to protrude into a refrigerating chamber.

According to a third aspect and feature of the present invention, in addition to the second feature, mounting plates are secured to the front end of the refrigerator body at opposite sides of the refrigerator body, thereby closing gaps defined respectively between the first and second side surfaces of the accommodating recess and the opposite sides of the refrigerator body, wherein the mounting plates can be fastened to the support wall. With such arrangement, the refrigerator body can be fixed to the support wall, while avoiding a reduction in aesthetic appearance due to the reason that the gaps on the opposite sides of the refrigerator body are visible from the outside.

According to a fourth aspect and feature of the present invention, in addition to the second or third feature, an upper cover having exhaust bores leading to the exhaust passage is mounted to the front end of the refrigerator body at an upper portion of the refrigerator body to cover the front end of the exhaust passage. With such arrangement, it is possible to avoid that the exhaust passage defined between the ceiling surface of the accommodating recess and the refrigerator body is visible from the outside, thereby enhancing the external appearance, and the air can be discharged from the exhaust passage to the outside, while preventing foreign matters from entering the exhaust passage from the outside.

According to a fifth aspect and feature of the present invention, in addition to the second or third feature, a lower cover having an intake bore leading to the intake passage is mounted to the front end of the refrigerator body at a lower portion of the refrigerator body to cover the front end of the intake passage. With such arrangement, it is possible to avoid that the intake passage defined between the bottom surface of the accommodating recess and the refrigerator body is visible from the outside, thereby enhancing the external appearance, and the air can be drawn into the intake passage from the outside, while preventing foreign matters from entering the intake passage from the outside.

The above and other objects, features and advantages of the invention will become apparent from the following description of the preferred embodiments taken in conjunction with the accompanying drawings.

BRIEF DESCRIPTION OF THE DRAWINGS

FIGS. 1 to 7 show a first embodiment of the present invention, wherein

FIG. 1 is a vertical sectional side view showing a refrigerator in a state in which it has been accommodated in an accommodating recess;

FIG. 2 is a sectional view taken along a line 2—2 in FIG. 1;

FIG. 3 is a front view of the refrigerator, taken in the direction of an arrow 3 in FIG. 1;

FIG. 4 is a side view taken in the direction of an arrow 4 in FIG. 3;

FIG. 5 is a sectional view taken along a line 5—5 in FIG. 3;

FIG. 6 is an exploded perspective view of a refrigerator body and a refrigerating unit;

FIG. 7 is an exploded perspective view of a front portion of the refrigerator.

DESCRIPTION OF THE PREFERRED EMBODIMENTS

Figure 1:
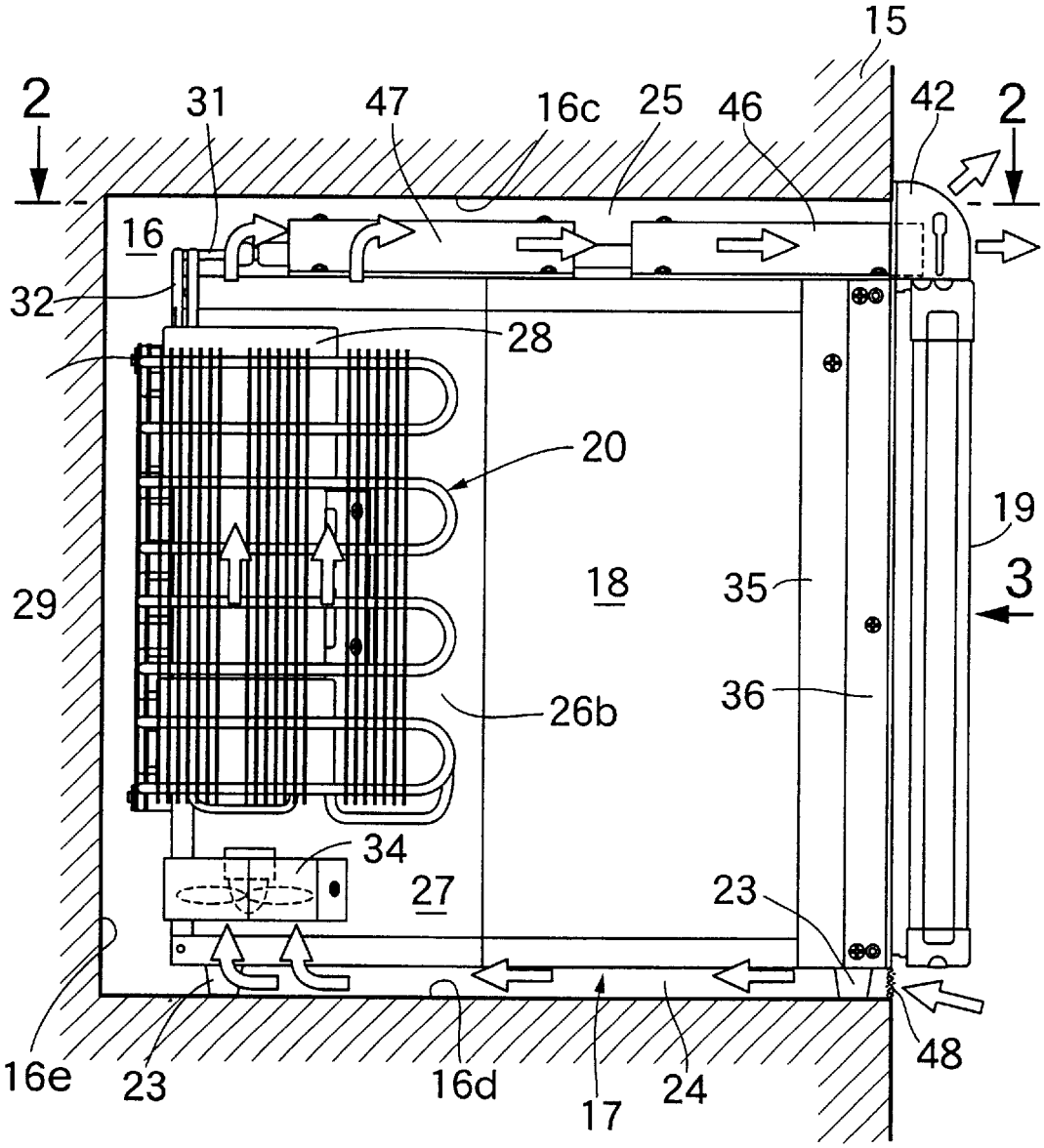
Figure 2:
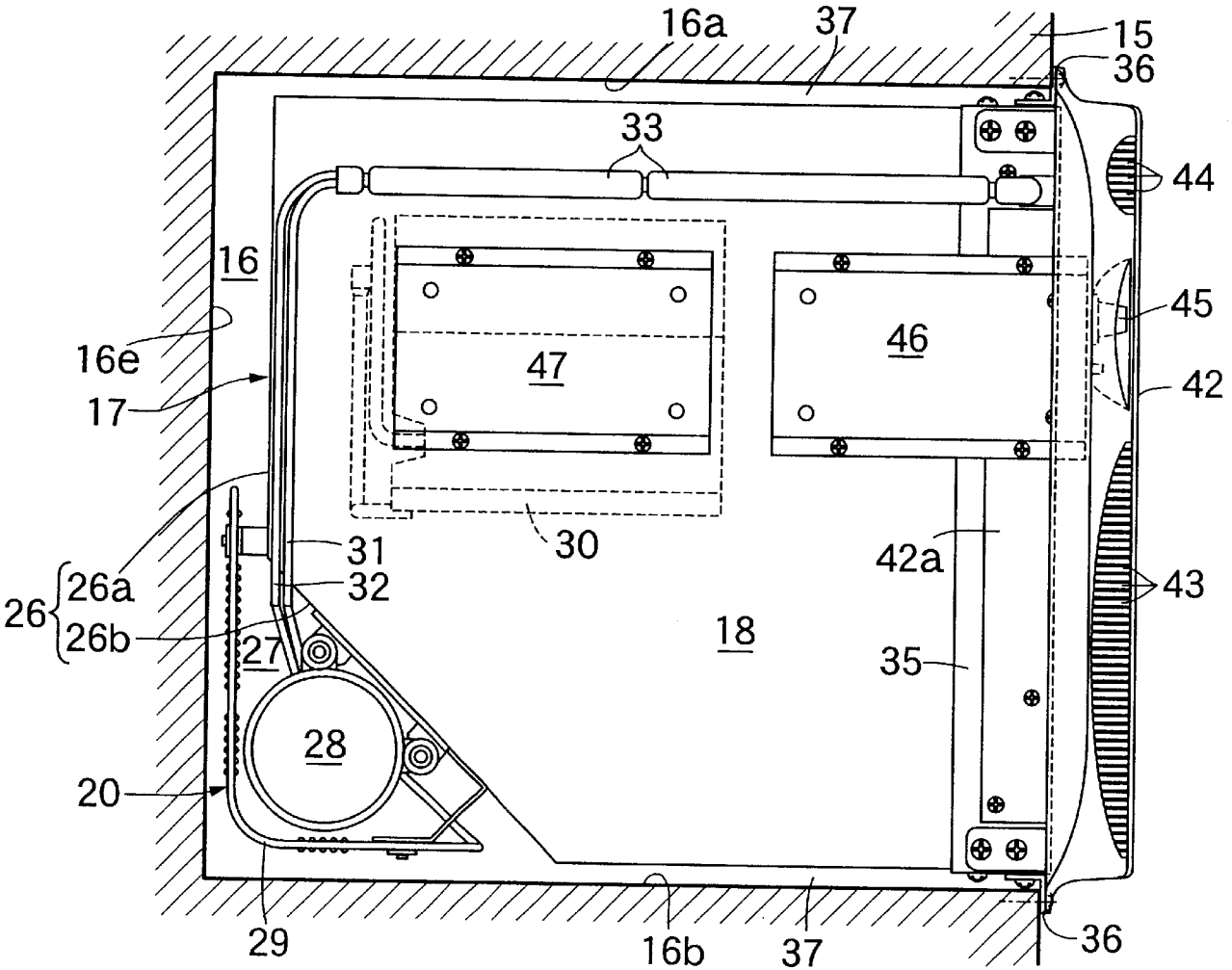

A first embodiment of the present invention will be described with reference to FIGS. 1 to 7. Referring first to FIGS. 1 and 2, a refrigerator 17 is carried, for example, on a large-sized vehicle such as a truck or a ship such as a cruiser, and mounted to a support wall 15 provided in the large-sized vehicle or the ship, with most of the refrigerator 17 accommodated in an accommodating recess 16 provided in the support wall 15.

The accommodating recess 16 is defined in the support wall 15 into a simple regular quadrilateral cross-sectional shape by (1) first and second side surfaces 16*a* and 16*b* extending vertically in parallel to each other, (2) a ceiling surface 16*c* connecting the upper ends of the first and second side surfaces 16*a* and 16*b* at right angles to each other, (3) a bottom surface 16*d* connecting the bottom ends of the first and second side surfaces 16*a* and 16*b* at right angles to each other, and (4) a closed end surface 16*e* connecting the rear ends of the ceiling surface 16*c* and the bottom surface 16*d* at right angles to each other.

The refrigerator 17 includes a refrigerator body 18, a door 19 mounted to a front surface of the refrigerator body 18, and a refrigerating unit 20. The refrigerator 17 is mounted to the support wall 15, so that the refrigerator body 18 is accommodated in the accommodating recess 16, and the door 19 can be opened and closed outside the accommodating recess 16.

Figure 3:
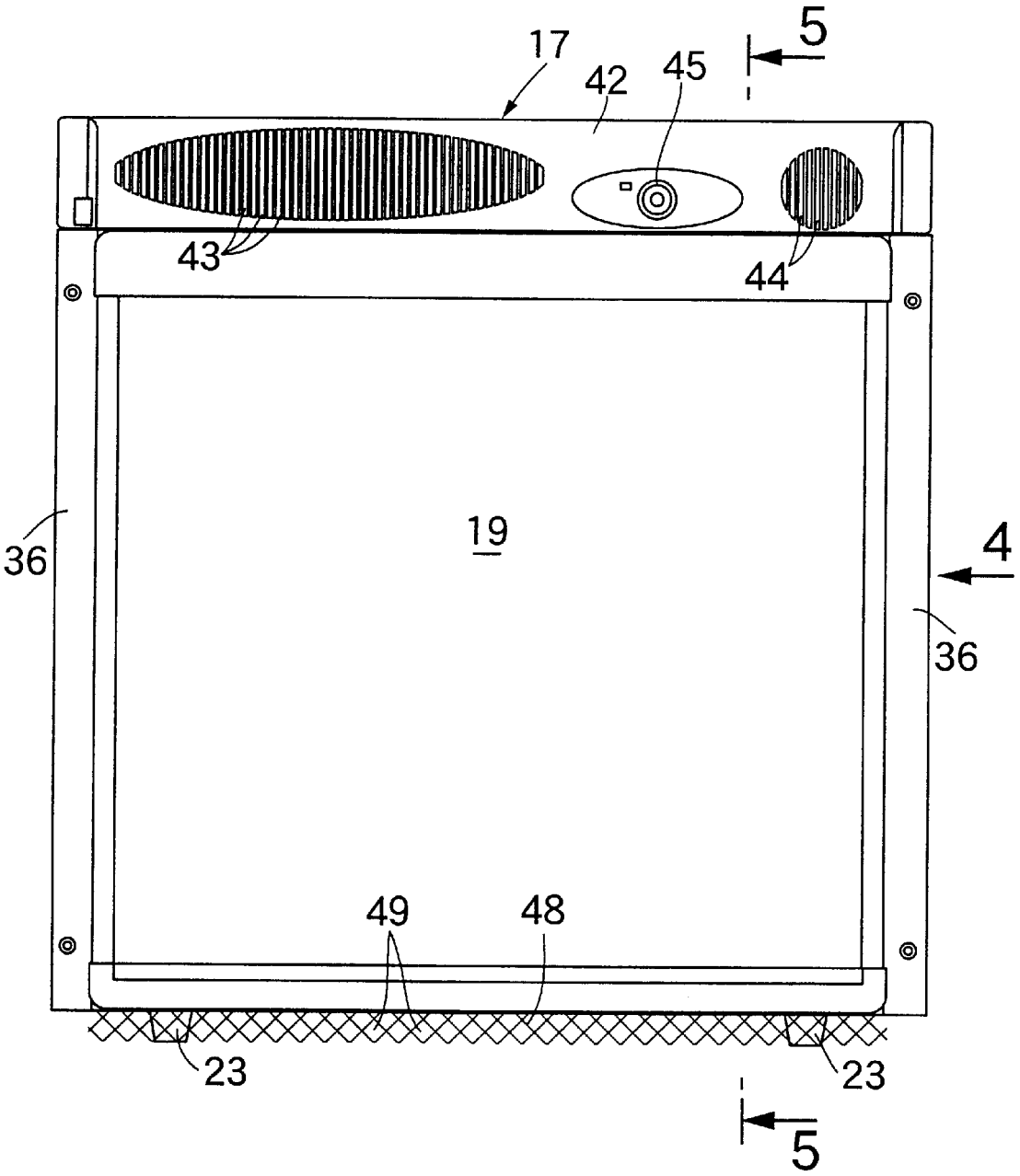
Figure 4:
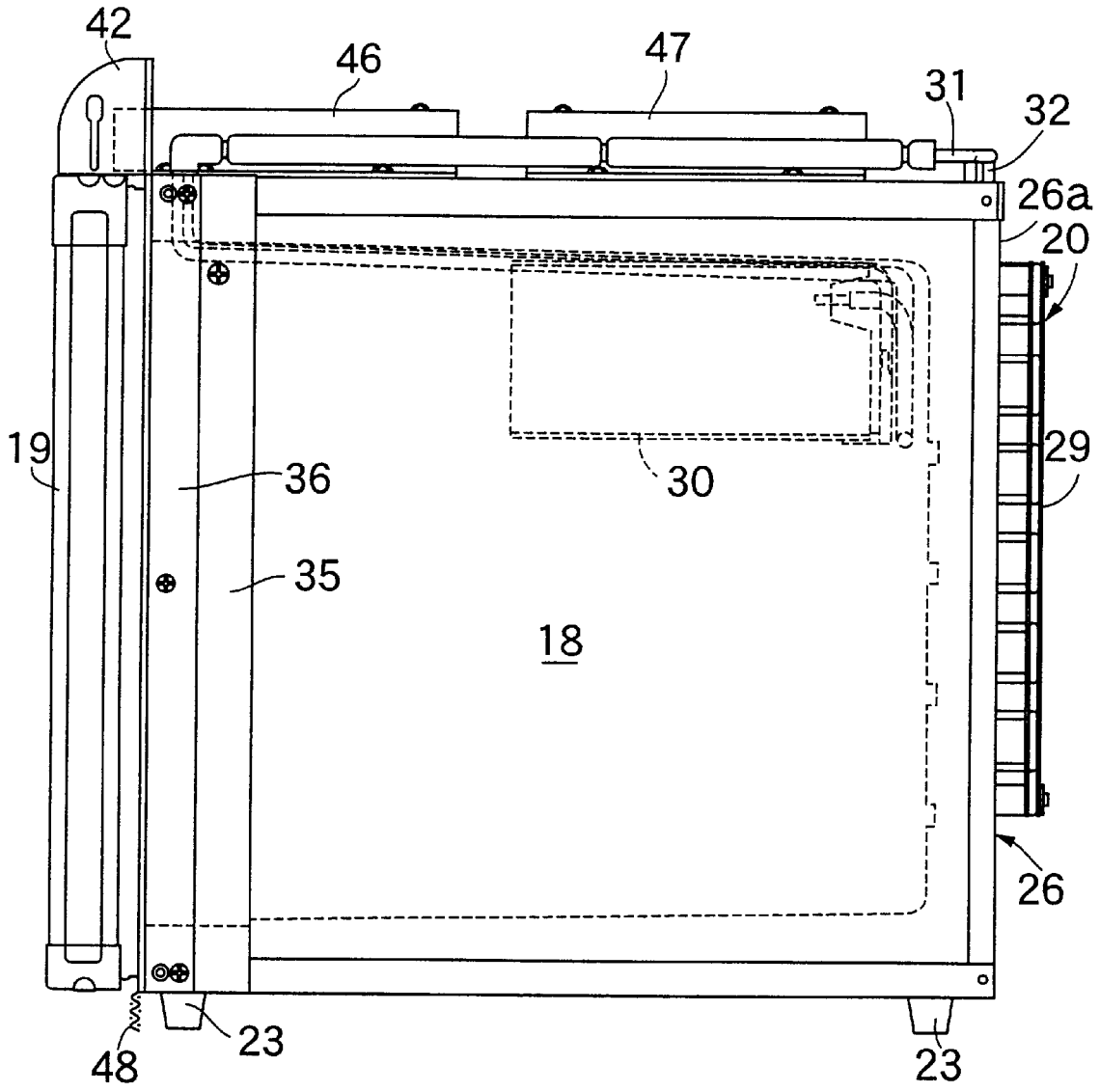
Figure 5:
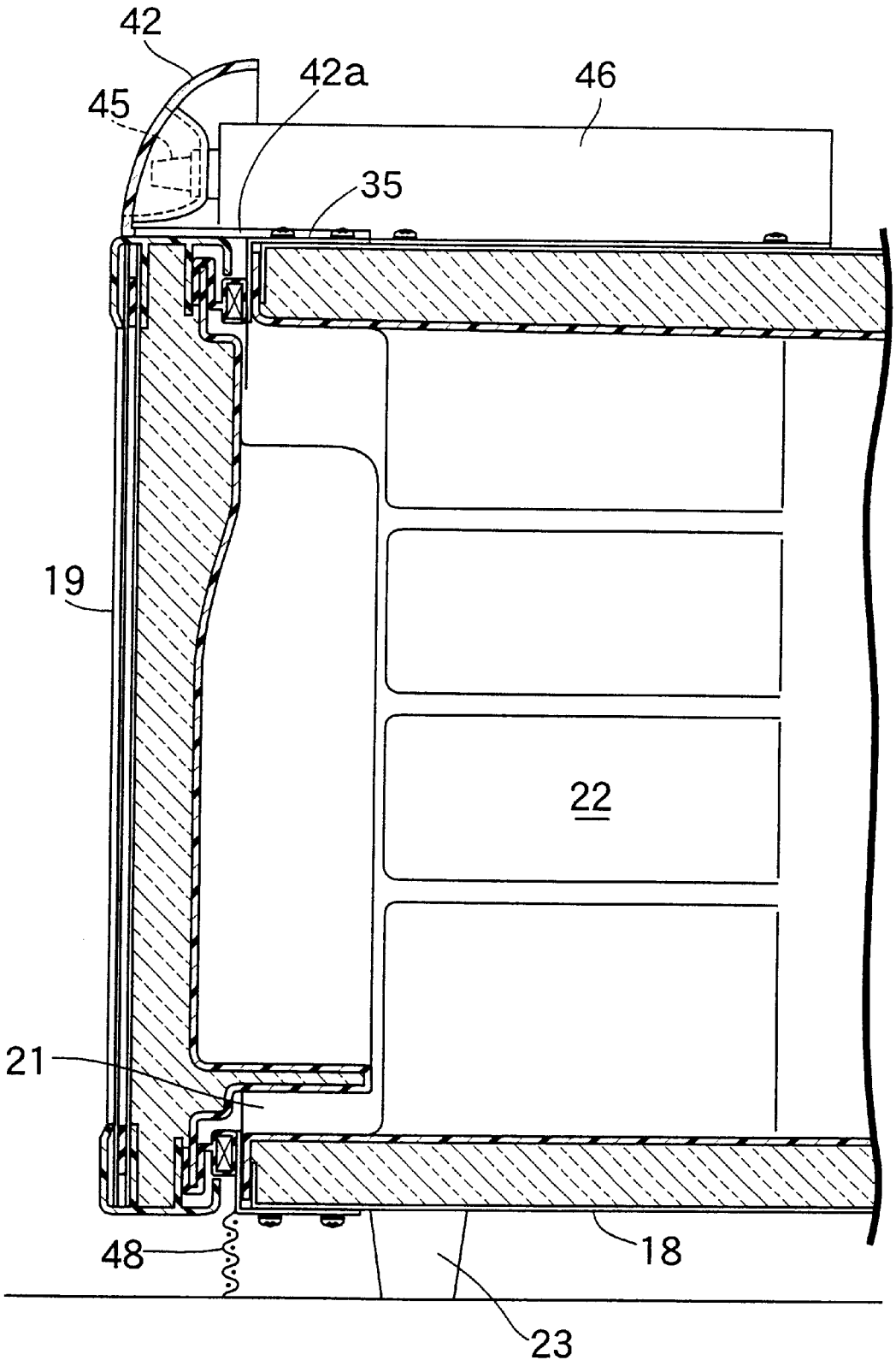

Referring further to FIGS. 3 to 5, the refrigerator body 18 is formed to have a regular quadrilateral vertical sectional shape with an opening 21 provided in its front surface, and a refrigerating chamber 22 is defined within the refrigerator body 18.

A plurality of legs 23 are provided on a bottom of the refrigerator body 18, and the accommodation of the refrigerator body 18 in the accommodating recess 16 ensures that an intake passage 24 is defined between the bottom surface 16*d* of the accommodating recess 16 and the refrigerator body 18, and an exhaust passage 25 is defined between the ceiling surface 16*c* of the accommodating recess 16 and the refrigerator body 18.

On the other hand, the refrigerator body 18 has a rear wall 26 which comprises a first wall portion 26*a* adjacent to the first side 16*a* and closer and opposed to the closed end surface 16*e* in parallel to the closed end surface 16*e* of the accommodating recess 16, and a second wall portion 26*b* adjacent to the second side 16*b* and inclined such that it is spaced farther from the closed end surface 16*e* as going away from the first wall portion 26*a*, the first wall portion 26*a* and the second wall portion 26*b* being connected to each other. A communication passage 27 which is triangular in cross section is defined between the second side surface 16*b* as well as the closed end surface 16*e* of the accommodating recess 16 and the second wall portion 26*b* of the rear wall 26, and extends vertically to connect rear ends of the intake passage 24 and those of the exhaust passage 25 to each other.

Figure 6:
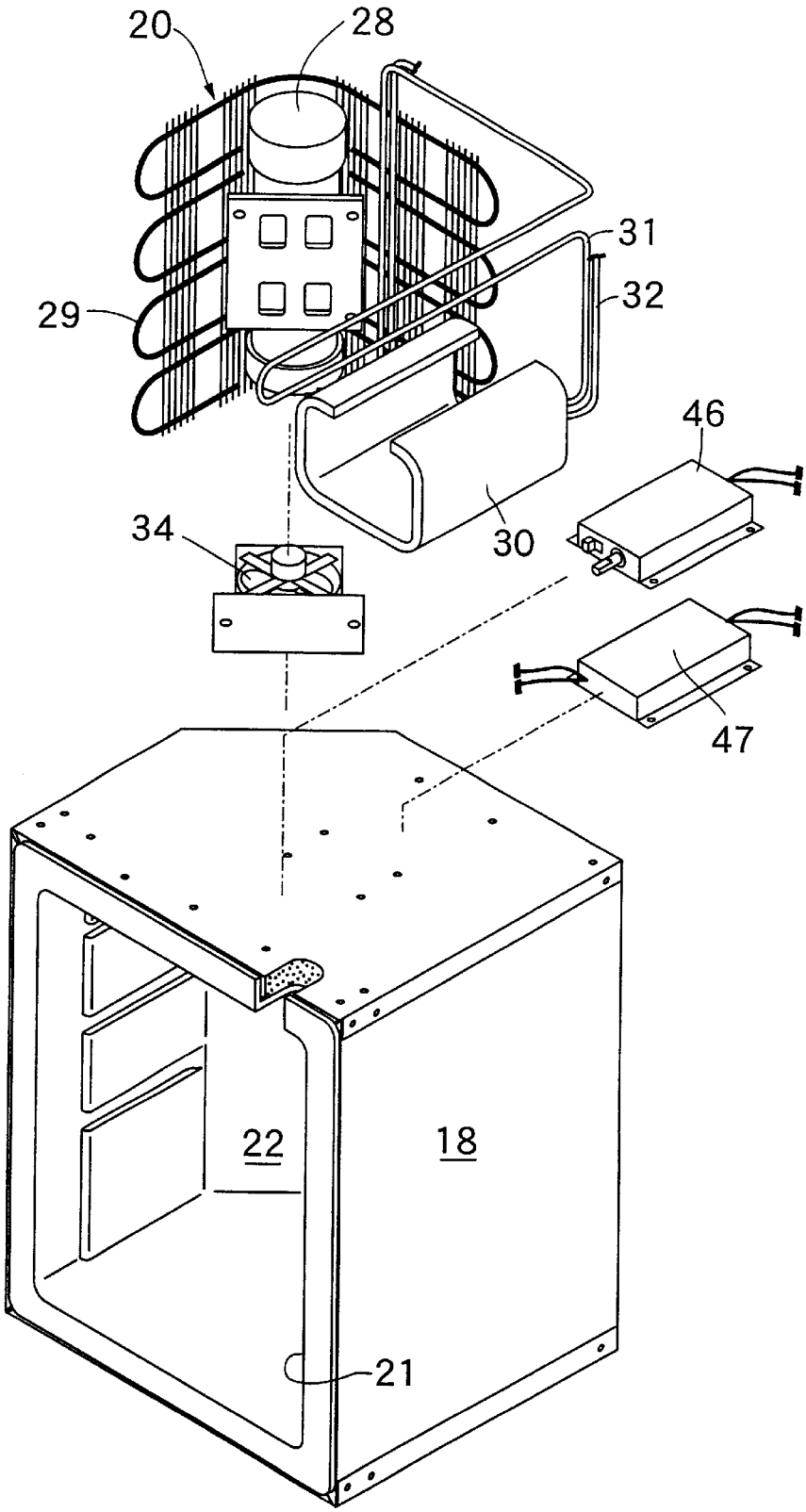

Referring also to FIG. 6, a refrigerating unit 20 for refrigerating the refrigerating chamber 22 includes a compressor 28 extending vertically to have, for example, a circular cross-sectional shape, a condenser 29 and an evaporator 30 and the like. The compressor 28 is mounted to an outer surface of the second wall portion 26*b* in the rear wall 26 of the refrigerator body 18, so that it is accommodated in the communication passage 27, and the condenser 29 accommodated in the communication passage 27 together with the compressor 28 is mounted to an outer surface of the first wall portion 26*a* in the rear wall 26 to surround the compressor 28. The evaporator 30 is formed, for example, into a substantially U-shape with its upper portion opened, and is fixed within the refrigerating chamber 22 to an inner surface of an upper portion of the refrigerator body 18 to define the freezing chamber between the evaporator 30 and the inner surface of the upper portion of the refrigerator body 18.

A conduit 31 for introducing a coolant evaporated in the evaporator 30 into the compressor 28 is extended forwards along the inner surface of the upper portion of the refrigerator body 18 within the refrigerating chamber 22; turned up and rearwards through 180 degrees at an front end of the refrigerator body 18; then extended rearwards along an outer surface of the upper portion of the refrigerator body 18 and connected to the compressor 28. A conduit 32 for introducing the coolant from the condenser 29 to the evaporator 30 is disposed to substantially overlap the conduit 31, and a protecting pipe 33, through which both the conduits 31 and 32 are inserted, is fixed to the outer surf ace of the upper portion of the refrigerator body 18.

A fan 34 having a motor is disposed below the compressor 28 and the condenser 29 for allowing air to flow upwards within the communication passage 27. The fan 34 is also mounted to the outer surface of the second wall portion 26*b* of the rear wall 26 of the refrigerator body 18. Thus, a flow of air from the intake passage 24 to the communication passage 27 is generated, as shown by an arrow in FIG. 1, by the operation of the fan 34 and thus, air flowing upwards within the communication passage 27 flows toward the exhaust passage 25.

Figure 7:
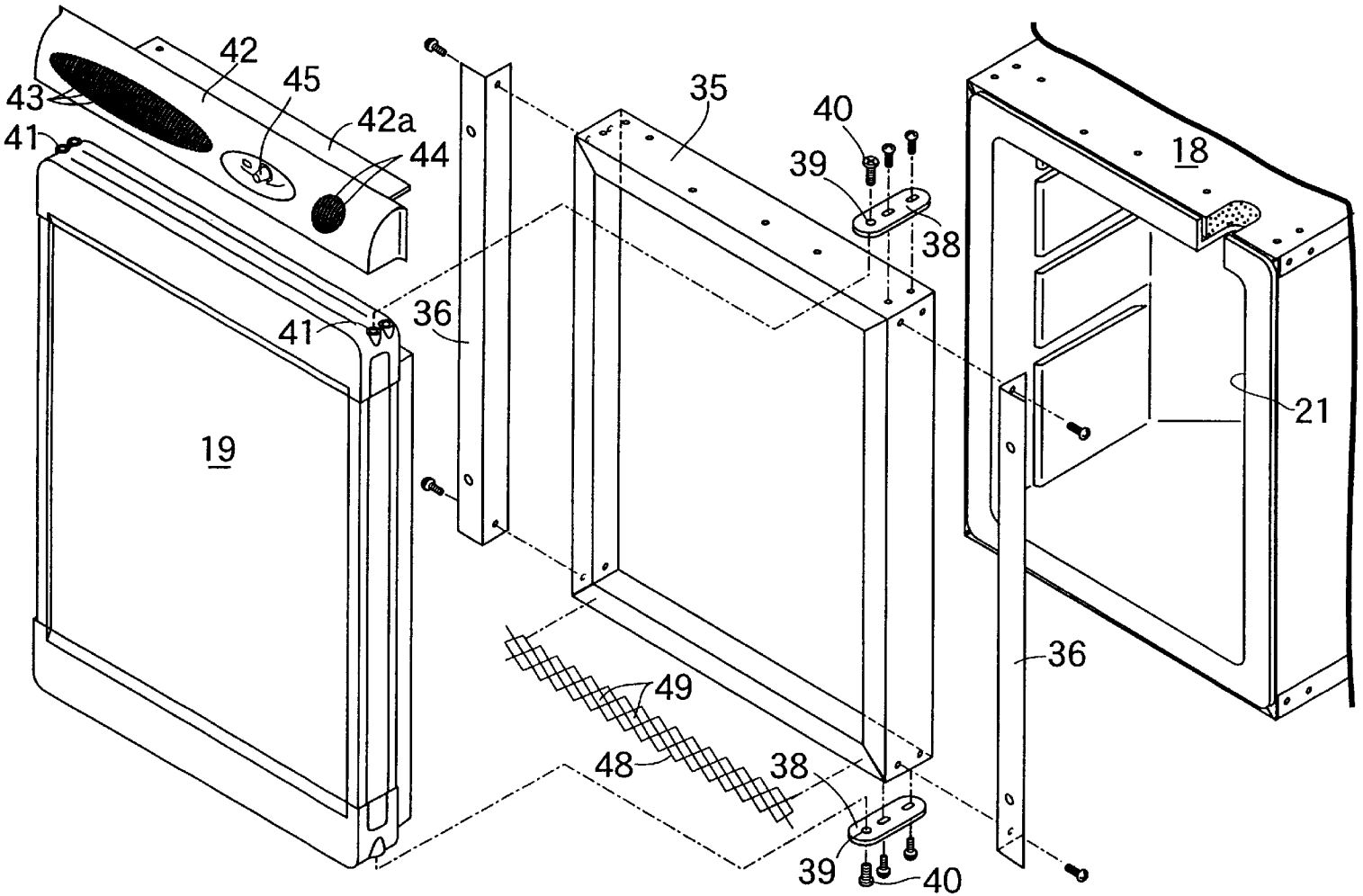

Referring also FIG. 7, a support frame 35 is secured to the front end of the refrigerator body 18, so that the entire periphery of the refrigerator body 18 is fitted to the support frame 35. Mounting plates 36, 36 each having a substantially L-shaped cross-sectional shape are secured to opposite sides of the support frame 35. The mounting plates 36, 36 are capable of being fastened to the support wall 15, and the refrigerator body 18 is fixed to the support wall 15 by the fastening of the mounting plates 36 to the support wall 15. Moreover, in a state in which the mounting plates 36 have been fastened to the support wall 15, the mounting plates 36 close front ends of gaps 37, 37 defined respectively between the first and second side surfaces 16*a* and 16*b* of the accommodating recess 16 and the opposite sides of the refrigerator body 18.

Support arms 38, 38 can be fastened to upper and lower portions of a support frame 35 so that they can be alternatively selected at either of its left or right portion, with their front portions protruding forwards from the support frame 35 in a connected relation to the support frame 35. Moreover, coaxial threaded bores 39, 39 are provided in front portions of the support arms 38, 38, and fitting bores 41 are provided left and right upper and lower portions of the door 19, respectively, and tip ends of screw members 40, 40 threadedly inserted through the threaded bores 39, 39 are fitted into the fitting bores 41. Thus, the door 19 is mounted to the support frame 35, i.e., the front surface of the refrigerator body 18 for rotation about axes of screw members 40, 40 by fitting of the screw members 40, 40 into the fitting bores 41, so that it can be selected properly whether the door 19 is opened leftwards or rightwards.

The front end of the exhaust passage 25 is covered with an upper cover 42 made of a synthetic resin, and a mounted plate 42*a* integrally included in the upper cover 42 is fastened to the upper end of the front portion of the refrigerator body 18, so that it is overlapped on an upper surface of the support frame 35.

Pluralities of exhaust bores 43 and 44 are provided in the upper cover 42 leading to the front end of the exhaust passage 25. One exhaust bores 43 are provided such that they extend vertically on the left of the upper cover 42, as the refrigerator 17 is viewed from the front. The exhaust bores 43 are disposed, so that a curved line connecting upper and lower ends of each of the exhaust bores 43 forms a laterally longer elliptic shape. The other exhaust bores 44 are provided such that they extend vertically on the right of the upper cover 42, as the refrigerator 17 is viewed from the front. The exhaust bores 44 are disposed, so that a curved line connecting upper and lower ends of each of the exhaust bores 44 forms a circular shape.

An operating dial 45 is disposed on the upper cover 42 between both the exhaust bores 43 and 44. A control box 46 for controlling the operation of the refrigerating unit 20 and the fan 34 depending on the operation of the operating dial 45 is fixed to the outer surface of the upper portion of the refrigerator body 18, and a power source box 47 for the refrigerating unit 20 and the fan 34 is fixed to the outer surface of the upper portion of the refrigerator body 18 in the rear of the control box 46.

The front end of the intake passage 24 is covered with a lower cover 48, which is formed, for example, of a net-shaped material defining a large number of intake bores 49 leading to the front end of the intake passage 24 and which is fastened to the front end of the lower portion of the support frame 36, i.e., to the lower portion of the front end of the refrigerator body 18.

The operation of the first embodiment will be described below. (1) The intake passage 24 into which the air can be drawn through the front end, (2) the exhaust passage 25 from which the air can be discharged through the front end, and (3) the communication passage 27 which connects the rear ends of the intake passage 24 and the exhaust passage 25 to each other and in which the compressor 28 and the condenser 29 are accommodated, are defined between the inner surface of the accommodating recess 16 provided in the support wall 15 and the refrigerator body 18 accommodated in the accommodating recess 16. In addition, the fan 34 which draws the air from the intake passage 24 and discharges the air toward the communication passage 27 is mounted to the outer surface of the rear wall 26 of the refrigerator body 18 and accommodated in the communication passage 27. Therefore, the air drawn into the intake passage 24 from the outside by the operation of the fan 34 is permitted to flow through the communication passage 27 and then discharged through the exhaust passage 25 to the outside, whereby the compressor 28 and the condenser 29 accommodated in the communication passage 27 are cooled effectively by the air flowing through the communication passage 27. Moreover, the intake passage 24, the communication passage 27 and the exhaust passage 25 are defined between the inner surface of the accommodating recess 16 and the refrigerator body 18 and hence, it is unnecessary to provide an intake bore and an exhaust bore in the support wall 15 in addition to the accommodating recess 16. Therefore, the aesthetic appearance can be enhanced by no need for the provision of such intake and exhaust bores, and the compressor 28 and the condenser 29 can be cooled sufficiently.

The accommodating recess 16 is defined into the simple regular quadrilateral cross-sectional shape by (1) the first and second side surfaces 16*a* and 16*b* extending vertically in parallel to each other, (2) the ceiling surface 16*c* connecting the upper ends of the first and second side surfaces 16*a* and 16*b* at right angles to each other, (3) the bottom surface 16*d* connecting the bottom ends of the first and second side surfaces 16*a* and 16*b* at right angles to each other, and (4)

the closed end surface 16*e* connecting the rear ends of the ceiling surface 16*c* and the bottom surface 16*d* at right angles to each other. In addition, the rear wall 26 of the refrigerator body 18 defining the intake passage 24 between the refrigerator body 18 and the bottom surface 16*c* and the exhaust passage 25 between the refrigerator body 18 and the ceiling surface 16*b,* and having the regular quadrilateral vertical sectional shape, comprises the first wall portion 26*a* adjacent to the first side surface 16*a* and closer and opposed to the closed end surface 16*e,* and the second wall portion 26*b* adjacent to the second side 26*b* and inclined such that it is farther spaced from the closed end surface 16*e,* as being farther spaced from the first wall portion 26*a,* the first wall portion 26*a* and the second wall portion 26*b* being connected to each other. The vertically extending communication passage 27 triangular in cross section is defined between the second side surface 16*b* as well as the closed end surface 16*e* of the accommodating recess 16 and the second wall portion 26*b*.

Therefore, the intake passage 24, the exhaust passage 25 and the communication passage 27 are defined only by accommodating the refrigerator body 18 in the accommodating recess 16. In addition, the cross-sectional area of the communication passage 27 can be set at a small value to the utmost, and the flow speed of the air flowing through the communication passage 27 can be increased to the utmost to enhance the efficiency of cooling the compressor 28 and the condenser 29. Moreover, the second wall portion 26*b* constituting a portion of the rear wall 26 of the refrigerator body 18 may be defined in such a manner that a corner at the rear end of the refrigerator body 18 is cut out. Thus, goods can be accommodated effectively in the entire refrigerating chamber deeply from its inlet end to its deep end, as compared with a refrigerator in which a central portion of a rear wall 26 is recessed to protrude into a refrigerating chamber.

The mounting plates 36, 36 are secured to the front end of the refrigerator body 18 on the opposite sides of the latter to close the front ends of the gaps 37, 37 defined respectively between the first and second sides 16*a* and 16*b* of the accommodating recess 16 and the opposite sides of the refrigerator body 18. Therefore, it is possible to avoid deterioration in the aesthetic appearance that may otherwise occur by the gaps 37, 37 on the opposite sides of the refrigerator body 18 being visible from the outside. Moreover, the mounting plates 36, 36 can be fastened to the support wall 15 and hence, the refrigerator body 18 can be fixed to the support wall 15.

In addition, the upper cover 42 having the exhaust bores 43 and 44 leading to the exhaust passage 25 are mounted to the front end of the upper portion of the refrigerator 18 to cover the front end of the exhaust passage 25. Therefore, it is possible to avoid that the exhaust passage 25 can be visually seen from the outside, thereby enhancing the external appearance, and to discharge the air from the exhaust passage 25 to the outside, while preventing foreign matters from entering the exhaust passage 25 from the outside. Further, the lower cover 48 having the intake bores 49 leading to the intake passage 24 is mounted to the front end of the lower portion of the refrigerator body 18 to cover the front end of the intake passage 24. Therefore, it is possible to avoid that the intake passage 24 can be visually seen from the outside, thereby enhancing the external appearance, and to draw the air from outside into the intake passage 24, while preventing foreign matters from entering the intake passage 24 from the outside.

Figure 8:
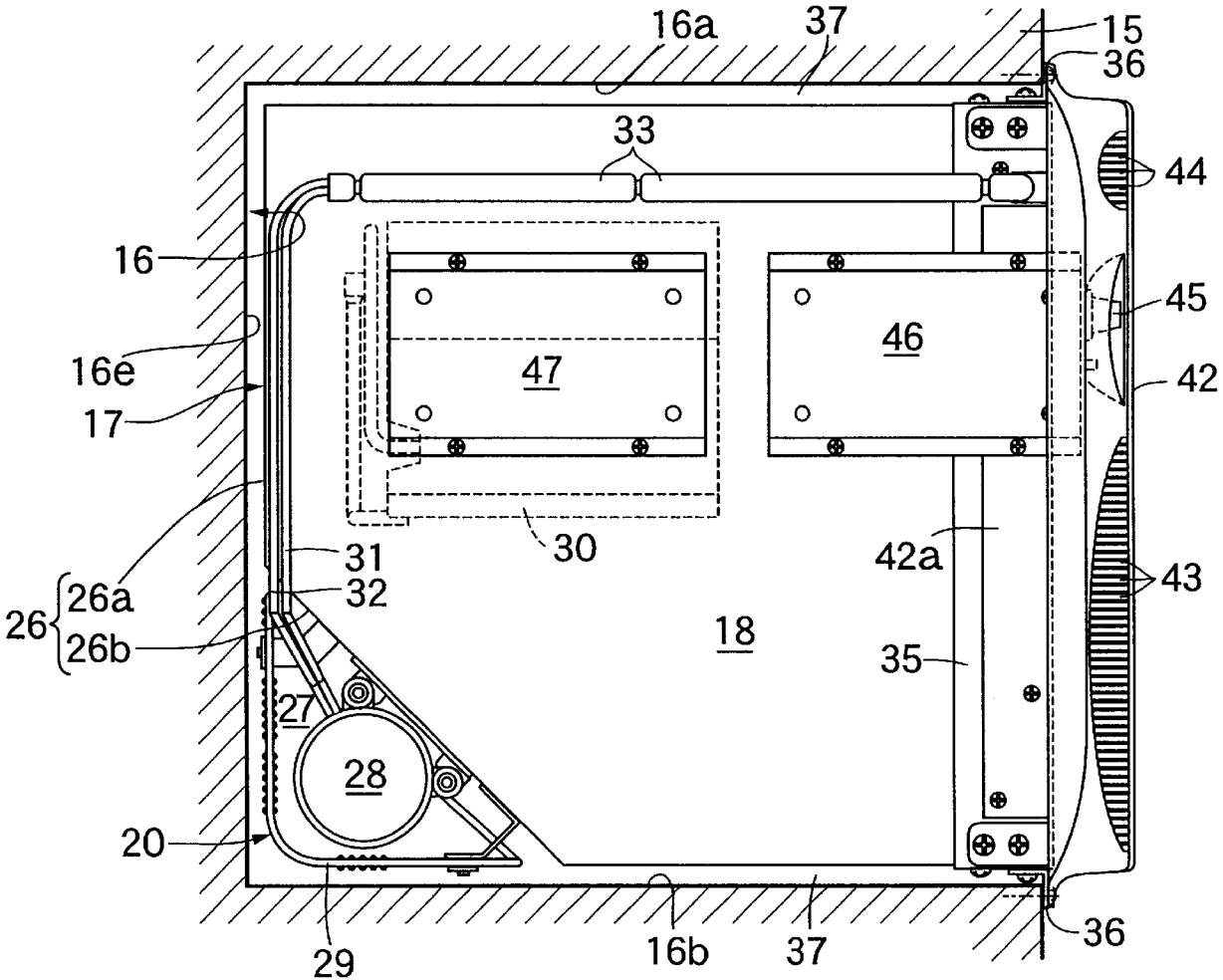
FIG. 8 is a sectional view similar to FIG. 2, but showing a second embodiment.

FIG. 8 shows a second embodiment of the present invention. A condenser 29 accommodated in a communication passage 27 together with a compressor 28 is mounted to an outer surface of a second wall portion 26*b* of a rear wall 26 of a refrigerator body 18 to surround the compressor 28. The first wall portion 26*a* of the rear wall 26 of the refrigerator body 18 can be provided in more proximity to a closed end surface 16*e* of an accommodating recess 16, whereby the dead space between the first wall portion 26*a* and the closed end surface 16*e* can be reduced, and a space within the accommodating recess 16 can be utilized more effectively. Moreover, the communication passage 27 can be formed more compactly, and the air drawn from the intake passage 24 can be permitted to flow in a further concentrated manner trough the communication passage 27, thereby enhancing the efficiency of cooling the compressor 28 and the condenser 29.

Although the embodiments of the present invention have been described in detail, it will be understood that the present invention is not limited to the above-described embodiments, and various modifications in design may be made without departing from the spirit and scope of the invention defined in claims.

What is claimed is:

1. A mounting and placing structure for a refrigerator including a refrigerator body having an opening in a front surface thereof and defining a refrigerating chamber, a door mounted on the front surface of said refrigerator body for opening and closing said opening, and a refrigerating unit for refrigerating said refrigerating chamber, said refrigerator further including a compressor and a condenser each constituting a portion of the refrigerating unit and mounted to an outer surface of a rear wall of said refrigerator body, said refrigerator being mounted to a stationary support wall such that said refrigerator body is accommodated in an accommodating recess provided in said support wall and said door can be opened and closed outside said accommodating recess, wherein said mounting and placing structure includes an intake passage into which air can be drawn through a front end thereof, an exhaust passage from which the air can be discharged through a front end thereof, and a communication passage which connects rear ends of said intake passage and said exhaust passage to each other, said compressor and said condenser being accommodated in said communication passage, and wherein said intake passage, said exhaust passage and said communication passage are defined between an inner surface of said accommodating recess and an outer surface of said refrigerator body accommodated in said accommodating recess to form an air flow passage along a bottom portion, a rear portion and a top portion of the outer surface of the refrigerator, and a fan is mounted to said rear wall of said refrigerator body and accommodated in said communication passage for drawing air from said intake passage and discharging the air into said exhaust passage.

2. A mounting and placing structure for a refrigerator according to claim 1, wherein said accommodating recess is defined by first and second side surfaces extending vertically in parallel to each other, a ceiling surface connecting upper ends of said first and second side surfaces at right angles to each other, a bottom surface connecting lower ends of said first and second side surfaces at right angles to each other, and a closed end surface connecting rear ends of said side surfaces, said ceiling surface and said bottom surface at right angles to each other; wherein said rear wall of said refrigerator body has a regular quadrilateral vertical-sectional shape and defines said intake passage between said refrigerator body and said bottom surface, and said exhaust passage between said refrigerator body and said ceiling surface, said rear wall including a first wall portion which is adjacent to said first side surface and closer and opposed to said closed end surface in parallel to said closed end surface, and a second wall portion which is adjacent to said second side surface and inclined such that it is spaced farther from said closed end surface as going away from said first wall portion, said first and second wall portions being connected to each other; and wherein said communication passage is of a triangular cross-sectional shape and extends vertically to connect said rear ends of said intake passage and said exhaust passage, said communication passage being defined between said second side surface as well as said closed end surface of said accommodating recess and said second wall portion.

3. A mounting and placing structure for a refrigerator including a refrigerator body having an opening in a front surface thereof and defining a refrigerating chamber, a door mounted on the front surface of said refrigerator body for opening and closing said opening, and a refrigerating unit for refrigerating said refrigerating chamber, said refrigerator further including a compressor and a condenser each constituting a portion of the refrigerating unit and mounted to an outer surface of a rear wall of said refrigerator body, said refrigerator being mounted to a stationary support wall such that said refrigerator body is accommodated in an accommodating recess provided in said support wall and said door can be opened and closed outside said accommodating recess, wherein said mounting and placing structure includes an intake passage into which air can be drawn through a front end thereof, an exhaust passage from which the air can be discharged through a front end thereof, and a communication passage which connects rear ends of said intake passage and said exhaust passage to each other, said compressor and said condenser being accommodated in said communication passage, and wherein said intake passage, said exhaust passage and said communication passage are defined between an inner surface of said accommodating recess and said refrigerator body accommodated in said accommodating recess, and a fan is mounted to said rear wall of said refrigerator body and accommodated in said communication passage for drawing air from said intake passage and discharging the air into said exhaust passage, wherein said accommodating recess is defined by first and second side surfaces extending vertically in parallel to each other, a ceiling surface connecting upper ends of said first and second side surfaces at right angles to each other, a bottom surface connecting lower ends of said first and second side surfaces at right angles to each other, and a closed end surface connecting rear ends of said side surfaces, said ceiling surface and said bottom surface at right angles to each other; wherein said rear wall of said refrigerator body has a regular quadrilateral vertical-sectional shape and defines said intake passage between said refrigerator body and said bottom surface, and said exhaust passage between said refrigerator body and said ceiling surface, said rear wall including a first wall portion which is adjacent to said first side surface and closer and opposed to said closed end surface in parallel to said closed end surface, and a second wall portion which is adjacent to said second side surface and inclined such that it is spaced farther from said closed end surface as going away from said first wall portion, said first and second wall portions being connected to each other; and wherein said communication passage is of a triangular cross-sectional shape and extends vertically to connect said rear ends of said intake passage and said exhaust passage, said communication passage being defined between said second side surface as well as said closed end surface of said accommodating recess and said second wall portion, further including mounting plates which are secured to the front end of said refrigerator body at opposite sides of said refrigerator body, thereby closing gaps defined respectively between said first and second side surfaces of said accommodating recess and the opposite sides of said refrigerator body, wherein said mounting plates can be fastened to said support wall.

4. A mounting and placing structure for a refrigerator including a refrigerator body having an opening in a front surface thereof and defining a refrigerating chamber, a door mounted on the front surface of said refrigerator body for opening and closing said opening, and a refrigerating unit for refrigerating said refrigerating chamber, said refrigerator further including a compressor and a condenser each constituting a portion of the refrigerating unit and mounted to an outer surface of a rear wall of said refrigerator body, said refrigerator being mounted to a stationary support wall such that said refrigerator body is accommodated in an accommodating recess provided in said support wall and said door can be opened and closed outside said accommodating recess, wherein said mounting and placing structure includes an intake passage into which air can be drawn through a front end thereof, an exhaust passage from which the air can be discharged through a front end thereof, and a communication passage which connects rear ends of said intake passage and said exhaust passage to each other, said compressor and said condenser being accommodated in said communication passage, and wherein said intake passage, said exhaust passage and said communication passage are defined between an inner surface of said accommodating recess and said refrigerator body accommodated in said accommodating recess, and a fan is mounted to said rear wall of said refrigerator body and accommodated in said communication passage for drawing air from said intake passage and discharging the air into said exhaust passage, wherein said accommodating recess is defined by first and second side surfaces extending vertically in parallel to each other, a ceiling surface connecting upper ends of said first and second side surfaces at right angles to each other, a bottom surface connecting lower ends of said first and second side surfaces at right angles to each other, and a closed end surface connecting rear ends of said side surfaces, said ceiling surface and said bottom surface at right angles to each other; wherein said rear wall of said refrigerator body has a regular quadrilateral vertical-sectional shape and defines said intake passage between said refrigerator body and said bottom surface, and said exhaust passage between said refrigerator body and said ceiling surface, said rear wall including a first wall portion which is adjacent to said first side surface and closer and opposed to said closed end surface in parallel to said closed end surface, and a second wall portion which is adjacent to said second side surface and inclined such that it is spaced farther from said closed end surface as going away from said first wall portion, said first and second wall portions being connected to each other; and wherein said communication passage is of a triangular cross-sectional shape and extends vertically to connect said rear ends of said intake passage and said exhaust passage, said communication passage being defined between said second side surface as well as said closed end surface of said accommodating recess and said second wall portion, further including an upper cover which has exhaust bores leading to said exhaust passage, said upper cover being mounted to the front end of said refrigerator body at an upper portion of said refrigerator body to cover the front end of said exhaust passage.

5. A mounting and placing structure for a refrigerator according to claim 3, further including an upper cover which has exhaust bores leading to said exhaust passage, said upper cover being mounted to the front end of said refrigerator body at an upper portion of said refrigerator body to cover the front end of said exhaust passage.

6. A mounting and placing structure for a refrigerator including a refrigerator body having an opening in a front surface thereof and defining a refrigerating chamber, a door mounted on the front surface of said refrigerator body for opening and closing said opening, and a refrigerating unit for refrigerating said refrigerating chamber, said refrigerator further including a compressor and a condenser each constituting a portion of the refrigerating unit and mounted to an outer surface of a rear wall of said refrigerator body, said refrigerator being mounted to a stationary support wall such that said refrigerator body is accommodated in an accommodating recess provided in said support wall and said door can be opened and closed outside said accommodating recess, wherein said mounting and placing structure includes an intake passage into which air can be drawn through a front end thereof, an exhaust passage from which the air can be discharged through a front end thereof, and a communication passage which connects rear ends of said intake passage and said exhaust passage to each other, said compressor and said condenser being accommodated in said communication passage, and wherein said intake passage, said exhaust passage and said communication passage are defined between an inner surface of said accommodating recess and said refrigerator body accommodated in said accommodating recess, and a fan is mounted to said rear wall of said refrigerator body and accommodated in said communication passage for drawing air from said intake passage and discharging the air into said exhaust passage, wherein said accommodating recess is defined by first and second side surfaces extending vertically in parallel to each other, a ceiling surface connecting upper ends of said first and second side surfaces at right angles to each other, a bottom surface connecting lower ends of said first and second side surfaces at right angles to each other, and a closed end surface connecting rear ends of said side surfaces, said ceiling surface and said bottom surface at right angles to each other; wherein said rear wall of said refrigerator body has a regular quadrilateral vertical-sectional shape and defines said intake passage between said refrigerator body and said bottom surface, and said exhaust passage between said refrigerator body and said ceiling surface, said rear wall including a first wall portion which is adjacent to said first side surface and closer and opposed to said closed end surface in parallel to said closed end surface, and a second wall portion which is adjacent to said second side surface and inclined such that it is spaced farther from said closed end surface as going away from said first wall portion, said first and second wall portions being connected to each other; and wherein said communication passage is of a triangular cross-sectional shape and extends vertically to connect said rear ends of said intake passage and said exhaust passage, said communication passage being defined between said second side surface as well as said closed end surface of said accommodating recess and said second wall portion, further including a lower cover which has an intake bore leading to said intake passage, said lower cover being mounted to the front end of said refrigerator body at a lower portion of said refrigerator body to cover the front end of said intake passage.

7. A mounting and placing structure for a refrigerator according to claim 3, further including a lower cover which has an intake bore leading to said intake passage, said lower cover being mounted to the front end of said refrigerator body at a lower portion of said refrigerator body to cover the front end of said intake passage.

8. A mounting and placing structure for a refrigerator according to claim 4, further including a lower cover which has an intake bore leading to said intake passage, said lower cover being mounted to the front end of said refrigerator body at a lower portion of said refrigerator body to cover the front end of said intake passage.

9. A mounting and supporting structure for a refrigerator according to claim 1, wherein said intake passage is defined between a bottom surface of the accommodating recess and said outer surface of the refrigerator body, and said exhaust passage is defined between a ceiling surface of the accommodating recess and said outer surface of the refrigerator body.

* * * * *